United States Patent [19]

Schauer

[11] 4,143,930

[45] Mar. 13, 1979

[54] SWIVEL CONNECTION

[75] Inventor: Friedrich Schauer, Heroldsberg, Fed. Rep. of Germany

[73] Assignee: Kabel-und Metallwerke Gutehoffnungshütte Aktiengesellschaft, Hanover, Fed. Rep. of Germany

[21] Appl. No.: 781,535

[22] Filed: Mar. 28, 1977

[30] Foreign Application Priority Data

Mar. 23, 1976 [DE] Fed. Rep. of Germany ..... 2612262

[51] Int. Cl.[2] ..... H01R 39/00

[52] U.S. Cl. ..... 339/6 R; 339/101; 339/177 E

[58] Field of Search ..... 339/6 R, 8 P, 8 R, 101, 339/177 E, 182 R, 182 RS

[56] References Cited

U.S. PATENT DOCUMENTS

| | | | |
|---|---|---|---|
| 3,950,052 | 4/1976 | Walter et al. | 339/8 R |
| 4,003,616 | 1/1977 | Springer | 339/8 R |

*Primary Examiner*—Roy Lake
*Assistant Examiner*—DeWalden W. Jones
*Attorney, Agent, or Firm*—Smyth, Pavitt, Siegemund, Jones & Martella

[57] ABSTRACT

The swivel plug is comprised of an integral member having a ring plus ridge bearing portion, and a cylindrical contact carrying portion whose front end serves also as bearing. The member has a generally flared opening for insertion of the cable. The member is made of hard plastic, e.g. nylon and partially embedded and filled by soft plastic, e.g. polyvinylchloride.

6 Claims, 4 Drawing Figures

SWIVEL CONNECTION

BACKGROUND OF THE INVENTION

The present invention relates to a swivel coupling for connection and feedthrough of an electrical cable to and through a relatively rigid case or housing of a piece of electrical equipment, appliance or the like.

Swivel couplers are needed, generally speaking, wherever a piece of electrical equipment is to be electrically connected to a power source under conditions which must permit more or less random orientation of the equipment to the source. Thus, any equipment that is being handled will be moved in relation to the connection which includes turning. Such equipment, including particularly machine tools, may include extensive linkage, pivot couplers etc., to be passed through by electrical conductors. In all these cases, twisting of the cable or conductors must be avoided. Usually, the connectors or cables are held in some fashion at the housing, and these locations endanger the cable and conductors particularly because strong tension twisting forces may be exerted.

The German printed patent application No. 2,153,418 proposes a coupler that permits unrestricted turning. The particular connector includes a body incorporating a mechanism which permits relative turning of two parts. Electrical conductors lead into each of these parts, and U-shaped contact elements as well as contact pins provide slip ring like electrical connection. This coupler, therefore, has many individual parts. Moreover, the electrically active parts serve additionally as bearings and wear correspondingly.

The German printed patent application No. 2,511,294 discloses a plug element having embedded a rather strong annulus with a bead-like bulge serving as bearing element and sliding in a matching groove-like complementary part in the casing or housing being traversed. This ring or annulus is quite small and since the plug element itself is quite soft, positioning of the annulus is difficult. This, in turn, poses difficulties in making electrical connections because the distance between the end of the plug and the surface of the annulus is quite difficult to maintain. Also, du to softness of the plug, it may bend so that the distance between the several contact elements may irreversibly change, leading to failure in contact making.

Other known swivel connections of more or less complicated construction are shown, e.g., in U.S. Pat. Nos. 3,957,331, 3,950,052, and 3,937,543.

DESCRIPTION OF THE INVENTION

It is an object of the present invention to provide a new and improved swivel connection for running an electrical connection into a housing or the like, whereby the swivel mount and bearing portion has an invariable, spatial relation to any contacts or contact mounts in the housing and which can be made in a simple and inexpensive manner.

In accordance with the preferred embodiment of the present invention, it is suggested to provide a single piece carrier member whose one end is constructed as ring with a ridge to be received in an annular groove of the housing serving as bearing, while the other end of that body positions and holds two contacts in concentric relation. The carrier-member has an opening for receiving the conductors. This carrier body is made of relatively strong insulating material and is partially embedded and receives soft plastic constituting a plug body molded around the cable end, and penetrating the opening of the carrier member, but leaving the ring and at least parts of the contacts exposed.

The carrier member is primarily responsible for the spacing between the ridge-bearing and the contacts, so that complementary parts in the housing can expect to cooperate with these parts in positive relationship, to wit, there are definite locations of contact making relative to the bearing support. Furthermore, the single piece construction of the carrier member is definitely larger than the ring itself. Therefore, this body poses no difficulties as to placement into a suitable machine to mold the plug body onto and around it. Any bending will be taken up by the soften plug body and not by the carrier so that its dimensions etc. remain invariant.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, the figures show a plug body element 1 of a swivel or rotatable connector for providing an electrical connection that passes through a casing wall 3. Electrical power is run to the plug element by a cable 2 whose conductors are embedded in plug body element 1.

Figure 4:
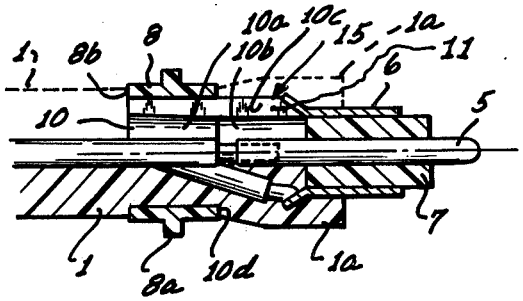
FIG. 4 is a section view along the plane indicated by lines 4—4 in FIG. 3, showing in addition in its lower half the molded-on plug body as shown otherwise in FIG. 1.

Plug 1 is comprised of relatively soft and flexible insulating material such as polyvinylchloride. Notches 4 serve as protection against bending and breakage of the embedded conductors. The conductors of cable 2 are connected electrically to a contact pin 5 and a ring 6. This connection is conventional and involves, e.g., soldering or the like. These connections are, of course, not visible from the outside as per FIG. 1, but are shown in FIG. 4.

In accordance with the invention, this swivel connector includes an integral or unitary carrier body or member 9 which is comprised of different, but integrally joined portions performing different functions but being spaced, as to the performance of these functions in a definite manner by operation of the integral construction. One portion of single piece member 9 is constructed as an annulus or ring 8 with a radially outwardly extending annular ridge 8*a*. The other end 7 of body 9 is of sleeve-like or cylindrical configuration, and has as its primary function the positioning of two contact elements 5 and 6. Pin 5 is inserted into that sleeve end 7 of member 9, while contact sleeve 6 sits on the sleeve 7. The latter has a conical shoulder against which abuts a conically, flared end portion of contact sleeve 6.

The portion 15 of body member 9 essentially provides for the spacing and positioning function of the contacts 5,6 in relation to ring 8, and particularly its ridge 8*a*.

Figure 3:
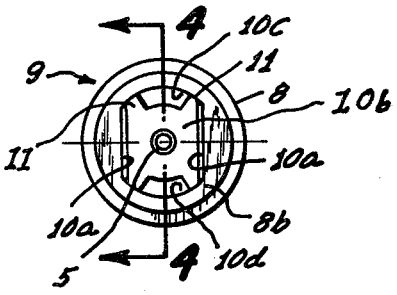
FIG. 3 is a front view as indicated by lines 3—3 in FIG. 2.

The body member 9 has a hollow interior or opening 10 which is partially round but has flat side walls 10*a*, so that generally, the ring 8 is quite thick. The ridge 8*a* extends radially opposite that opening 10. Reference numeral 8*b* denotes the end face of ring 8 as seen head on in FIG. 3. The opening 10 has a generally inwardly flaring surface portion 10*b*, which narrows down to a cylindrical bore that is the interior of sleeve 7 and receives pin 5 in a tight clamping fit. The opening 10 has two cylindrical (rather than conical) continuations which lead to openings 10*c*, 10*d* for connecting a wire (or two) to the flared portion of contact sleeve 6. Ridges 11 remain in-between these continuations and openings 10*c* and 10*d*, and serve as support ribs for connecting ring 8 to sleeve 7.

Figure 1:
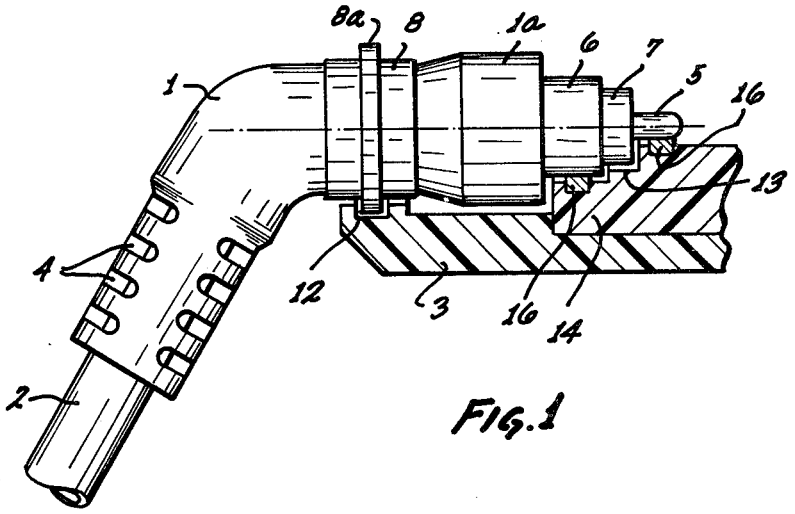
FIG. 1 is a side view of a swivel connector in accordance with the preferred embodiment of the invention and showing a casing or housing wall in which the connector is inserted in section.
Figure 2:
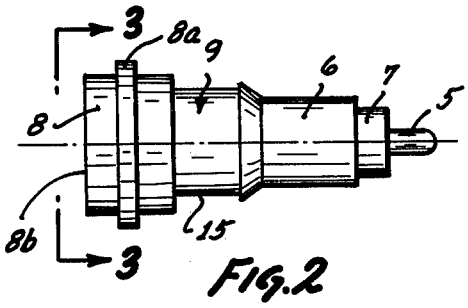
FIG. 2 is a side view of the carrier member included in the swivel connector of FIG. 1.

The member 9 is made of a strong, insulating material such as a polyamid (nylon). It is sufficiently strong so that annulus 8 and ridge 8*a* can serve as bearing elements, and sleeve 7 ensures concentricity between the contacts 5 and 6. As shown in FIG. 1, ridge 8*a* is received in an annular groove 12 in housing wall 3 so that the plug element with part or member 9 embedded is rotatably mounted thereto. The front end of sleeve 7 may rest in a shoulder portion 13 of a contact carrier 14, which is particularly positioned in wall 3. The contacts are denoted 16.

The spatial relation between groove 12 and part 14 is invariable and determines the relative position of the stationary contacts on part 14 to that groove 12. The unitary member element 9 of strong material determines likewise and fixes the spacing between bead or ridge 8*a* and the front end of sleeve 7, so that upon insertion of ridge 8*a* in groove 12 the contacts 5 and 6 have the needed position which will not change by flexing or otherwise.

It can also be seen that 13 serves as an additional bearing for the plug element so the contacts 5, 6 are completely releaved from any load bearing fucntion as far as swiveling is concerned. The contact pressure and contact making engagement is, therefor, no longer dependent upon the turning action of and mechanical load on the plug element.

The assembly is made in the following manner. Part of member 9 is made as single piece by a suitable molding process applicable for nylon. Next, pin 5 is pushed into the bore of sleeve 7, and sleeve 6 is placed thereon; the fit may also be a tight one to hold the sleeve 6 on sleeve 7 by clamping.

Next, the conductors of cable 2 are inserted in opening 10 and, e.g., soldered or otherwise affixed to contacts 5 and 6. This preassembled combination of the carrier body member 9 with contacts in place and connected, is placed into a suitable casting or extrusion tool for molding a body for plug 1 onto and around these parts. Pursuant to this molding process, soft plastic material penetrates all voids still unoccupied of opening 10, and due to the flat surfaces 10*a*, member 9 now becomes fixed to the plug body 1, and will not rotate thereon or therein. The plastic plug part or body member 1*a* is molded over part of the connecting portion 15 of member 9, and the contact sleeve 6 is partically embedded in a plastic, whereby particularly the outer flared portion will be covered to prevent axial slip-off of the sleeve 6. Also, plastic will be placed around the poriton of pin 5 which penetrates the flared portion of opening 10 to provide for additional affixing of the pin. The plug parts 1 and 1*a* are made integrally joined through the flow of material through openings 10*c* and 10*d*.

The resulting plug element can now be inserted in the casing or housing in that ridge 8*a* rests in groove 12, and sleeve 7 rests on shoulder 13, so that the plug elements thereby as mounted for swivel action and contact making. It can readily be seen that the plug element is of simple construction, and, in addition to the two contacts, only two parts are needed; the carrier body 9 is the essential element and 1 and 1*a* is really only a filler and embedding body of soft plastic.

The invention is not limited to the embodiments described above but all changes and modifications thereof not constituting departures from the spirit and scope of the invention are inteded to be included.

I claim:

1. Swivel coupling for connecting and feeding through an electrical connection that includes a cable, into and through a housing of a piece of electrical equipment, appliance, tool, or the like, comprising:

an integral member made of relatively strong insulating material and having a first, annular portion with a radially outwardly extending ridge and a second cylindrical portion serving as contact carrier, there being a pair of contacts mounted on said cylindrical portion in concentrical relation thereto, and to each other, said member having an internal opening radially opposite said ridge, said opening receiving the ends of conductors of the cable for connection to the contacts; and relatively soft plastic plug body means molded onto the member to embed the ends of the conductors and the connection of the conductors to the contacts as penetrating said opening, but leaving the outer surface of the first annular portion and the ridge exposed.

2. Coupling as in claim 1, wherein the opening has at least one keying surface to impede rotation between the body means and the member.

3. Coupling as in claim 1, wherein the member has a conical shoulder against which abut a conical portion of one of the contacts, the body means holding the conical portion against the conical shoulder.

4. Swivel coupling for connecting and feeding through an electrical connection that includes a cable, onto and through a housing of a piece of electrical equipment, appliance, tool, or the like, comprising:

an integral member made of relatively strong insulating material and having a first, annular portion with a ridge and a hollow interior accessible from one end of the member, there being at least one opening behind the ridge with reference to the one end, further having a second cylindrical portion serving as contact carrier and axially bounding the hollow interior:

there being a pair of contacts mounted respectively in and on said cylindrical portion in concentrical relation to each other, said opening being between the ridge and the cylindrical portion as carrying one of the contacts on the outside, the hollow interior of said member receiving the ends of conductors of the cable for connection to the contacts; and relatively soft plastic plug body means molded onto the member to embed the ends of the conductors as connected to the contacts in the said hollow interior and penetrating through said opening for partially covering an outer one of the contacts, but leaving the outer surface of the first annular portion and the ridge and at least a portion of the contacts exposed.

5. Coupling as in claim 4, wherein the hollow interior has at least one keying surface to impede rotation between the body means and the member.

6. Coupling as in claim 4, wherein the member has a conical shoulder against which abut a conical portion of one of the contacts, the body means holding the conical portion against the conical shoulder.

* * * * *